United States Patent [19]

Bührer

[11] 3,989,086

[45] Nov. 2, 1976

[54] METHOD OF AND APPARATUS FOR THE PRODUCTION OF MOLD PARTS FOR FOUNDRIES

[76] Inventor: Erwin Bührer, Vogelingasschen 40, Schaffhausen, Switzerland

[22] Filed: Sept. 23, 1974

[21] Appl. No.: 508,328

[30] Foreign Application Priority Data

Sept. 26, 1973 Switzerland ..... 13795/73

[52] U.S. Cl. ..... 164/22; 141/67; 164/201

[51] Int. Cl.[2] ..... B22C 15/22; B65B 1/06

[58] Field of Search ..... 164/20, 22, 193, 194, 164/198, 201, 192, 410, 200, 202; 141/12, 67, 68, 71, 73, 80

[56] References Cited

UNITED STATES PATENTS

| | | | |
|---|---|---|---|
| 2,611,938 | 9/1952 | Hansberg | 141/67 UX |
| 2,613,409 | 10/1952 | Miller | 164/22 |
| 3,163,894 | 1/1965 | Bego et al. | 164/202 |
| 3,217,364 | 11/1965 | Genest | 141/67 X |
| 3,253,304 | 5/1966 | Hatch | 164/202 X |
| 3,461,948 | 8/1969 | Londal | 164/201 |
| 3,474,836 | 10/1969 | Schwake | 141/67 |
| 3,613,770 | 10/1971 | Janke | 164/22 |

*Primary Examiner*—Francis S. Husar
*Assistant Examiner*—John S. Brown
*Attorney, Agent, or Firm*—Toren, McGeady and Stanger

[57] ABSTRACT

A storage vessel filled with a granular composition for forming mold parts has a bottom opening aligned with an opening in a pressure vessel located directly below the storage vessel. Upon being filled with the granular composition from the storage vessel, the pressure vessel is arranged so that the opening can be closed. The pressure vessel is movable vertically toward and away from the storage vessel. In its upper position it can be filled with the composition, and in its lower position can evacuate the granular composition into a cavity in a core molding device through nozzles situated at the bottom of the pressure vessel. The nozzles are directed into bores in the molding device and allow the granular material to exit when a compressed air source within the pressure vessel is activated.

15 Claims, 5 Drawing Figures

METHOD OF AND APPARATUS FOR THE PRODUCTION OF MOLD PARTS FOR FOUNDRIES

BACKGROUND OF THE INVENTION

The present invention relates to a method of and an apparatus for the production of mold parts for foundries using a pressure vessel arranged to be filled with a granular composition, and to supply the composition into a molding device.

Mold producing apparatuses are well-known in the art, German Pat. No. 620,779 shows a sand blowing machine where material can be blown from a fixed storage vessel via a fixed intermediate vessel into a core box. By opening two valves, the intermediate vessel is filled with the material and then, by closing the valves and opening two additional valves, the contents of the intermediate vessel are discharged into the core box, whereupon the additional two valves are again closed. When the storage vessel is evacuated, the cover can be removed and the vessel refilled.

Swiss Pat. No. 183,838 discloses a method of evacuating storage vessels containing granular material using a gaseous pressure medium acting on the surface of the material charged in the vessel, and a movable plate contained in the vessel. To fill the storage vessel, the cover of the vessel is removed along with the parts connected to it and after refilling, the cover is replaced. A special airlock can be placed on the storage vessel for use during the filling operation. In an intermediate phase of the operation, the granular material can be transferred into opened airlocks after which they are closed.

German Pat. No. 1,162,033 shows a shot machine for making foundry molds and cores which correlates a compressed air storage chamber with a vessel for receiving granular composition and surrounded by an interspace. The storage chamber, filled with compressed air, is connected by means of a quick-action shot valve with a large passage opening to the filled, closed sand vessel. The granular composition flows via several nozzles into a mold box, or the like, and fills it. After the filling, the shot machine is vented via a membrane valve. A refill vessel arranged above the sand vessel and firmly connected to it, is spatially separated from it by a closed slide valve. By opening the slide valve, the vessel is filled with the granular composition, whereupon the slide valve is closed.

The above devices, however, have the disadvantages that they must blow the granular composition either by means of compressed air from a storage vessel into an intermediate vessel and then into a core box, or that, because of the time consuming manner of filling the storage vessel, they must select a very large volume or use additional compressed air storage chambers, and, therefore, operate with very high compressed air consumption.

Further disadvantages lie in that the storage vessels connected with the pressure vessels for receiving the granular composition can, for structural reasons, contain only small volumes, and, therefore, lead to frequent stoppages for refilling.

Another disadvantage is that the storage and pressure vessels are fixedly connected together. Thus, it is necessary to lift the core boxes which are to be filled before the filling process, and to lower them again after finishing the process. This limits the application of the blowing method.

The development of organic binders for granular compositions widened the area of application of the shooting of foundry mold parts. As a result, the amount of granular composition required per hour is increased. Therefore, a definite disadvantage ensues because the large volume storage bins could not be directly correlated to the devices developed for the blowing method.

SUMMARY OF THE INVENTION

It is the object of the present invention to eliminate the above disadvantages. The problem is solved in that the pressure vessel is raised for the filling of the granular composition and is opened by lifting a displacement body. The opening then receives the granular material flowing from the storage vessel.

The pressure vessel is mounted directly beneath the storage vessel so that when the opening of the storage vessel is opened, the granular material will flow down into the pressure vessel. After the pressure vessel is filled, the openings at the top and the bottom of the storage vessel are closed. However, when the bottom opening or the pressure vessel is closed, a displacement body connected to a closure means for closing the opening will displace the granular material in the pressure vessel, so that the granular material situated above the opening will fall into the pressure vessel. The displacement body is of greater size than the closure means so that enough space is provided in the pressure vessel for the granular material pushed in by the closure means.

After the pressure vessel is filled, it is moved downwardly away from the storage vessel and toward a core molding device. The pressure vessel has a plurality of nozzles, or dies, with orifices that extend outwardly from the bottom of the pressure vessel and mate with bores in the core molding device. By providing compressed air within the pressure vessel, the granular material is forced out through the orifices and into a cavity of the core molding device.

In an embodiment of the invention, the pressure vessel is filled a plurality of times for filling the same mold.

In another embodiment of the invention, the pressure vessel is spaced from the core molding device when in its lowered position so that the orifices do not extend all the way through the bores of the molding device, and allow a constricted portion of the bore for sealing engagement with the orifice.

In still another embodiment of the invention, the means for closing and opening the orifices is a lifting means having a rod attached to a closure body for closing the orifice.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE INVENTION

Figure 1:
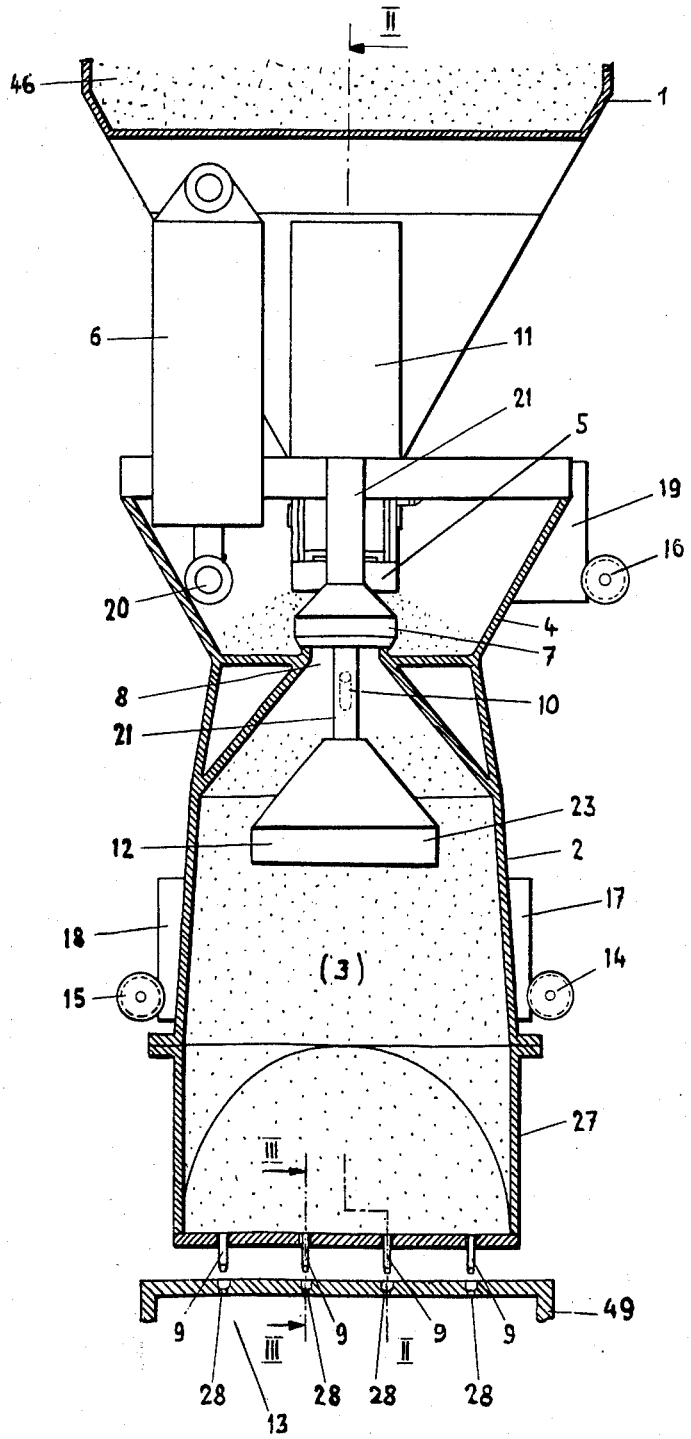
FIG. 1 is a partial sectional view taken along line I—I of FIG. 2.
Figure 2:
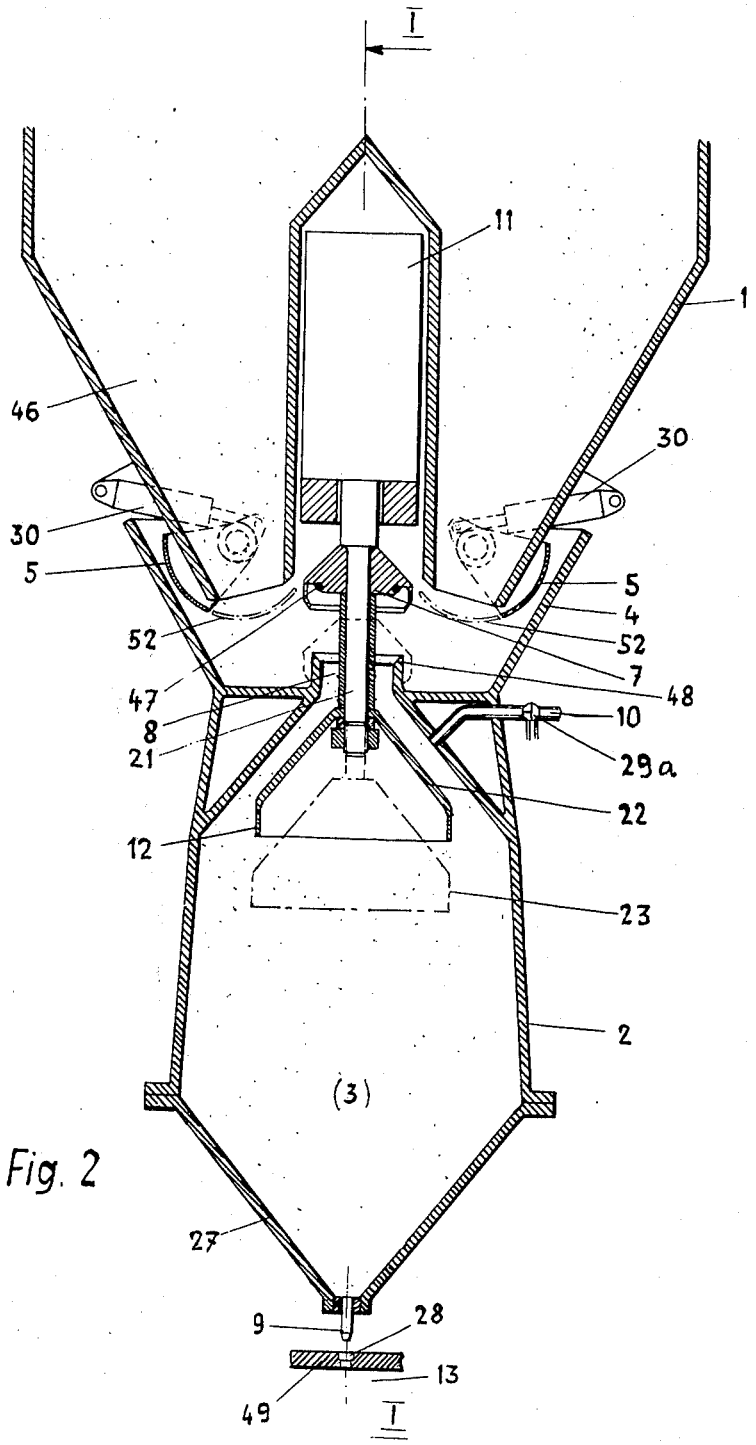
FIG. 2 is a partial sectional view taken along line II—II of FIG. 1.

In FIGS. 1 and 2, a storage vessel 1, and a pressure vessel 2 are both filled with a granular composition 46 and 3, respectively. The storage vessel 1 is mounted directly above the pressure vessel 2 and has a bottom closure 5. The bottom closure 5 can be alternately opened and closed by means of piston-cylinders 30 (FIG. 2). Each cylinder 30, which is controlled by any conventional means, is pivotally connected to a closure element so that upon activation the closure elements 5 can pivot from the closed, dotted line position 52 to the open full-line position in FIG. 2. The closure elements are pivoted by the cylinders 30 via a linkage mechanism that connects the piston of the cylinders 30 with a pivot shaft mounting the closure elements.

The pressure vessel 2 is guided for reciprocating movement toward and away from the storage vessel 1 by guide rolls 14, 15, 16 and guide rails 17, 18, 19 mounted on the pressure vessel. A piston-cylinder arrangement 6 having one end connected to a base portion of the storage vessel 1 and the other end connected to an upper catch bowl 4 of the pressure vessel 2 by means of a bolt 20, reciprocates the pressure vessel 2. The upper catch bowl 4 extends upwardly from the main portion of the pressure vessel 2 and is shaped as a truncated cone enclosing the bottom closure 5 of the storage vessel 1. An opening 8 of the pressure vessel is formed at the bottom of the upper catch bowl 4 and lies directly beneath the bottom closure 5 of the storage vessel 1.

A closure body 7 having a cross-sectional area sufficient to close off the opening 8 is reciprocated toward and away from the opening 8 by a lifting device 11, for example, a piston-cylinder arrangement, mounted in a space between the closure elements of the closure 5. A piston-rod 21 of the lifting device 11 mounts the closure body 7, and extends through the opening 8. A displacement body or receiver means 12 is attached to the piston-rod 21 below the opening 8 and operates together with the piston-rod 21 and closure body 7, as a unit. By activating the lifting device, the closure body 7 and displacement body or receiver means 12 can be moved from the open, full-line position in FIG. 2, to a closed, dotted-line position in FIG. 2 where the closure body completely seals off the opening 8 (see FIG. 1). In order to seal off the opening 8 properly when the closure body is in its lowered position, a packing ring 47 is positioned within the body 7 (FIG. 2) and mates with a packing surface 48 provided at the opening 8. In its lowered position, the closure body 7 surrounds the packing surface 48 and seals off the opening 8 by means of the ring 47.

Figure 3:
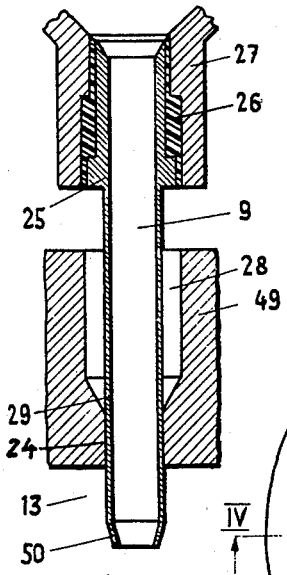
FIG. 3 is an enlarged detail view taken along line III—III of FIG. 1.

The pressure vessel 2 has a bottom, detachable V-shaped portion 27 which mounts a plurality of nozzles 25 (FIG. 3). Each nozzle 25 forms an orifice 9 and is exchangeably secured to the vessel by means of an epoxy resin filling 26. The orifices 9 extend in line with bores or orifices 28 of a core molding device 49. When the pressure vessel 2 is lowered by the cylinder 6, the orifices 9 of the nozzles 25 extend through and beyond the bores or orifices 28 of the core molding device 49.

The core molding device 49 has a cavity 13 for forming the mold. The bores 28 of the molding device 49 have an enlarged portion 29 for initially receiving the orifices 9, and a constricted portion 24 having an inner diameter sized to have a tight fit with the orifice 9. The tip 50 of the orifices 9 are formed into a truncated-cone to allow for easy flow of the granular composition when evacuated from the pressure vessel 2 into the cavity 13 of the core molding device 49. The tips 50 of the orifices 9 are designed to fit the physical properties of the particular granular composition being used, so that the granular composition will not flow out of the orifices 9 in a pressure-free state. The granular composition is evacuated through the orifices 9 and tips 50 by a compressed air nipple 10 arranged in the top part of the pressure vessel 2 which is connected to a source of compressed air (not shown) via a valve 29*a*. By activation of the valve, compressed air is forced through the air nipple 10 and the granular composition 3 contained in the pressure vessel 2 is shot out via the orifices 9 into the cavity 3.

The operation of the apparatus is as follows. The pressure vessel 2, shown in its upper, lifted position in FIG. 2, has its opening 8 open with the closure body 7 held in its upper position by the lifting device 11. The bottom closure 5 is then opened by activating the piston-cylinders 30 and the granular composition 46 contained in the storage vessel 1 flows down into the catch bowl 4 and flows into the main part of the pressure vessel 2 through the opening 8. When the pressure vessel is full, and the granular material builds up in the catch bowl 4, the closure 5 is stopped-up by the granular composition in the closure bowl 4. The cylinders 30 are then reactivated to close the closure elements to the dotted line position 52 in FIG. 2 and shut off the storage vessel. By activating the lifting device 11, the closure body 7 along with the displacement body 12 is lowered until the packing ring 47 is seated on the packing surface 48 and the displacement body is in position 23 shown in full line in FIG. 1 and in dash line in FIG. 2. The displacement body, when moved into its lowered position, displaces and clears a volume on the pressure vessel 2 equal to the volume of the base area of the displacement body 12 multiplied by the stroke of the displacement body. During the movement of the displacement body 12 from position 22, note FIG. 2, to position 23, the granular composition 46 initially accumulated in the catch bowl 4 can flow into the cavity of the pressure vessel created by the displacement body 12. This clears the packing surface 48 and the packing ring 47 can seat on the packing surface. At this time, the pressure vessel 2 is translated from its upper, filling position, to its lowered position by activating the lifting device 6 as shown in FIG. 3. By actuation of valve 29*a*, compressed air flows through nipple 10 into the vessel 2, and the granular composition is shot through the outlet orifices 9 into the cavity 13 of the core or pattern molding device 49. After the cavity is filled, valve 29*a* is again actuated so that it closes the compressed air nipple 10 and vents the pressure vessel 2. The lifting device is again activated to lift the pressure vessel 2 into its upper position and the opening 8 is opened by the lifting device 11. While another molding device is brought into the blowing position, the bottom closure 5 is again opened and the process is again repeated.

The control of the lifting device can be accomplished by hand, automatically as a sequence control, or by a central control member. All of these controls are well-known in the art.

The dimensions of the bottom closure 5, the storage vessel 1, and the catch bowl 4, as well as the opening 8, are determined by the physical properties of the granular composition, such as its fluidity.

It has proved expedient to select the displacement body 12 larger in diameter than the opening 8 and closure body 7. Therefore, when the displacement body is lowered, a larger volume is cleared in the pressure vessel 2 than is required for the granular composition flowing from the catch bowl 4.

The displacement body 12 is also designed so that its lower portion is a thin-walled cylindrical jacket piece open at the bottom so that it can penetrate the granular composition with little difficulty.

In another embodiment of the invention, the pressure vessel 2 is spaced from the core molding device 49 when the pressure vessel is in its lowered position. The space is such that the constricted portion 24 of the bores 28 form a sealing surface for the orifices 9 and thereby prevent the orifices 9 from extending beyond the bores.

Figure 4:
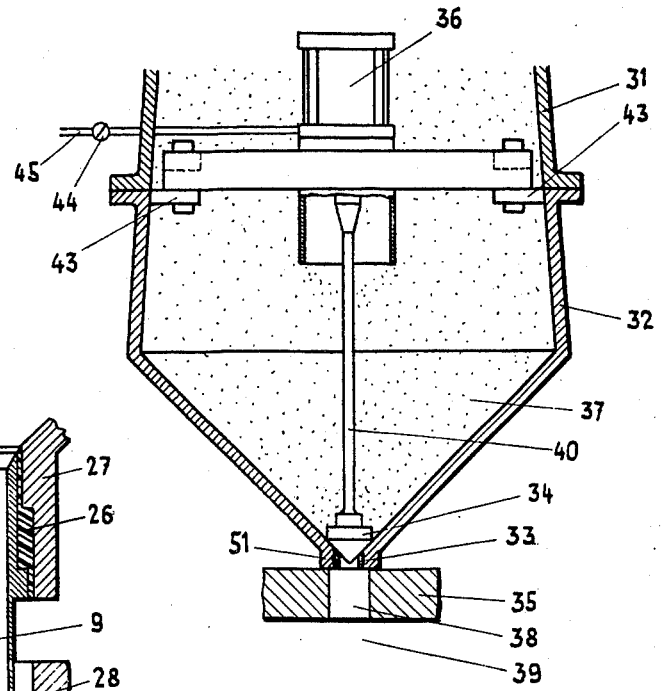
FIG. 4 is a partial sectional view taken along line IV—IV of FIG. 5.
Figure 5:
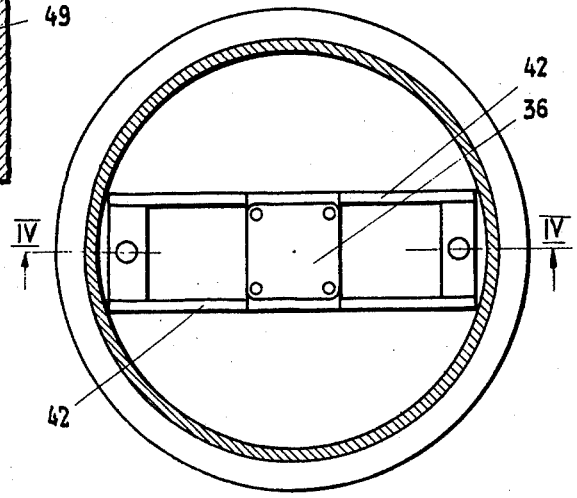
FIG. 5 is a top view of FIG. 4.

FIGS. 4 and 5 show another embodiment of the invention. A pressure vessel 31 has a lower portion 32 and a bushing 51 surrounding an outlet opening 33 for evacuating the granular composition 37. The opening 33 can be opened or closed by a closure body 34 which is connected to a lifting device 36 through a flexible rod 40. The closure body 34 is shaped so as to conform to the shape of the opening 33 and thereby present a tight fit. The lifting device 36 is mounted on the pressure vessel 31 by beams 42 and flanges 43 which are connected to the bottom portion 32 of pressure vessel 31. A central valve 44 supplies compressed air to the lifting device 36 through a line 45, and also supplies air to the air nipple contained in the pressure vessel for evacuating the granular composition as described above.

The embodiment of FIGS. 4 and 5 operates as described above with regard to the filling and evacuation processes. The difference is that the bottom portion 32 of the pressure vessel 31 has a closure body 34 for the opening 33. This form of construction is used when the outlet opening is selected especially large and where the granular composition could unintentionally exit from the pressure vessel 31 when no compressed air is supplied. The arrangement of the closure body 34 as provided can also be used when the opening is of normal size but the granular composition is unusually fluid.

The embodiment of FIGS. 4 and 5 operates as follows. When the pressure vessel 31 is filled with the granular composition 37, the closure body bears against the opening 33. The steps as described in respect to the embodiment of FIGS. 1–3 are carried out except that when compressed air is supplied to the air nipple it is also supplied to the lifting device 36 via line 45 so that the lifting device lifts the body 34 away from the opening 33 and opens it. The pressure vessel is then evacuated as above, and fills a cavity of a core molding device. After filling, the pressure vessel 31 is vented and the lifting device 36 is reversed by control of valve 44, and the closure body 34 again bears against the opening 33. The opening 33 is unlike the orifices described in the embodiment of FIGS. 1–3 in that the bushing 51 bears against the top of the core molding device 35. The opening 33 is of smaller diameter than the opening 38 of the core molding device which leads into the cavity 39.

Another embodiment of the invention provides that the same mold is produced by a plurality of successive fillings and compressed air shots. For this embodiment, the pressure vessel according to FIGS. 4 and 5 is closed suddenly by the closure body 34 by actuating valve 44. After the venting of the pressure vessel 31, the latter is filled again in the manner described and the whole process is repeated until the cavity 39 of the core molding device 35 is filled. Experience has shown that by means of a sudden interruption of the closing process when filling the device 35, the latter is filled perfectly tight by a plurality of successive shots. This, however, is only true when in blowing a mold, the shooting process starts suddenly and is interrupted suddenly. In order that the pressure vessel 31 can never be completely evacuated, the process of closing outlet 33 is controlled automatically by a time switch or by a pressure-sensitive switch provided in the pressure vessel 31. The control is especially important because if the pressure vessel 31 is blown empty, the device 35 will fill with compressed air and burst.

While specific embodiments of the invention have been shown and described in detail to illustrate the application of the inventive principles, it will be understood that the invention may be embodied otherwise without departing from such principles.

What is claimed is:

1. A method for producing foundry mold parts comprising the steps of arranging a storage vessel to contain a volume of granular composition therein and providing an opening in the bottom thereof for allowing the composition to exit, positioning a pressure vessel directly beneath said storage vessel and providing an entrance opening at the top thereof in line with said opening in said storage vessel so that the granular composition may empty into said pressure vessel, arranging a plurality of nozzles protruding from the lower part of said pressure vessel, arranging a core molding device for forming mold parts and having orifices therein directly beneath said pressure vessel with said orifices located to mate with said nozzles for receiving granular composition contained in said pressure vessel, raising said pressure vessel toward said storage vessel by utilization of means operatively engaged between said pressure vessel and said storage vessel for moving said vessels toward and away from each other, opening the entrance of said pressure vessel by operation of opening and closing means for said entrance, filling said pressure vessel with the granular composition by allowing the composition to exit from said storage vessel via the bottom opening into the entrance opening, providing a void in said pressure vessel when said entrance is open by operation of receiver means attached to said opening and closing means for movement therewith, closing the entrance opening of said pressure vessel by operation of said opening and closing means and simultaneously causing said granular material to flow from around said entrance opening into said pressure vessel by causing said receiver means to receive the granular composition when said opening and closing means is operated to close said entrance opening, lowering the pressure vessel toward said core molding device by operation of said means operatively engaged between said pressure vessel and said storage vessel for moving said vessels toward and away from each other, and evacuating the composition in said pressure vessel into said molding device through said nozzles by operation of means operatively connected with said pressure vessel.

2. The method according to claim 1, wherein said step of filling the pressure vessel with the granular composition comprises opening the bottom opening of the storage vessel to allow the composition to exit, and closing the bottom opening when the pressure vessel has been filled.

3. The method according to claim 1 including the steps of opening said orifice means at the beginning of said evacuatin step and closing said orifice means at the end of said step.

4. The method according to claim 1 wherein said step of evacuating the granular composition into said molding device comprises supplying compressed air to the interior of the pressure vessel.

5. The method according to claim 1, wherein said step of closing the entrance of the pressure vessel comprises displacing granular composition contained in said pressure vessel downwardly by operation of said receiver means located within the pressure vessel.

6. Apparatus for producing foundry mold parts comprising a storage vessel arranged to contain a volume of granular composition therein and having an opening in the bottom thereof for allowing the composition to exit, a pressure vessel positioned directly beneath said storage vessel and having an entrance opening at the top thereof in line with said opening in said storage vessel so that the granular composition may empty into said pressure vessel, a plurality of nozzles protruding from the lower part of said pressure vessel, means operatively engaged between said pressure vessel and said storage vessel for moving said vessels toward and away from each other, means opratively associated with said pressure vessel for closing said entrance opening of said pressure vessel, a core molding device for forming mold parts located directly beneath said pressure vessel and having orifices arranged to mate with said nozzles for receiving the granular composition contained in said pressure vessel, means operatively connected with said pressure vessel for evacuating the composition in said pressure vessel into said molding device, and receiver means attached to said means for closing said entrance opening of said pressure vessel for movement therewith, said receiver means providing a void in said pressure vessel when said closing means is in an open position, and said receiver means receiving the granular composition when said closing means is moved to the closed position so as to cause granular composition to flow from around said entrance opening into said pressure vessel.

7. The apparatus according to claim 6, wherein said storage vessel comprises means for closing the opening of said storage vessel at the completion of filling said pressure vessel.

8. The apparatus according to claim 6, wherein said means for closing said entrance opening of said pressure vessel comprises a closure body, and lifting means for reciprocating said body toward and away from said entrance opening.

9. The apparatus according to claim 8, wherein said means for evacuating comprises a compressed air jet mounted inside said pressure vessel.

10. The apparatus according to claim 6, wherein said molding device comprises a cavity therein and a plurality of bores for receiving said nozzles and communicating with the cavity, said nozzles comprising orifices protruding from said pressure vessel, said orifices, when said pressure vessel is in its lowered position, extending through said bores into said cavity.

11. The apparatus according to claim 6, wherein said molding device comprises a cavity therein and a plurality of bores for receiving said nozzles and communicating with the cavity, each of said bores having a lower constricted portion, each of said nozzles having an orifice extending outwardly from said pressure vessel, and said pressure vessel when in its lowered position being spaced from said molding device so that the constricted portion of each bore forms a sealing surface for said orifices.

12. The apparatus according to claim 6, further comprising means for closing said nozzles when the evacuation is completed, and said core molding device having bores arranged to align with the nozzles in said pressure vessel.

13. The apparatus according to claim 12, wherein said means for closing said nozzles comprises closure means for movement toward and away from said nozzles, each of said nozzles comprises a bushing arranged to contact said molding device about the bore aligned with its respective nozzles, and means for moving said closure means toward and away from said nozzles.

14. The apparatus according to claim 13, further comprising means for controlling said closure means for said nozzle which automatically close the nozzles at a preset time so that not all of the granular material contained in the pressure vessel is evacuated.

15. Apparatus according to claim 6 wherein said means for moving said vessels toward and away from each other comprises a lifting device having one end connected to said storage vessel and the other end connected to said pressure vessel.

* * * * *